United States Patent [19]

Kawawa

[11] Patent Number: 4,619,308

[45] Date of Patent: Oct. 28, 1986

[54] MOLD FOR HORIZONTALLY AND CONTINUOUSLY CASTING MOLTEN METAL INTO CAST METAL STRAND

[75] Inventor: Takaho Kawawa, Tokyo, Japan

[73] Assignee: Nippon Kokan Kabushiki Kaisha, Tokyo, Japan

[21] Appl. No.: 734,771

[22] Filed: May 16, 1985

[30] Foreign Application Priority Data

Jun. 4, 1984 [JP] Japan ..... 59-113145

[51] Int. Cl.[4] ..... B22D 11/04

[52] U.S. Cl. ..... 164/416; 164/440; 164/418; 164/478

[58] Field of Search ..... 164/440, 490, 418, 459, 164/416, 478

[56] References Cited

U.S. PATENT DOCUMENTS 3,076,241 2/1963 Simonson et al. ..... 164/440 X

FOREIGN PATENT DOCUMENTS 2009000 6/1979 United Kingdom ..... 164/440

*Primary Examiner*—Kuang Y. Lin

*Attorney, Agent, or Firm*—Frishauf, Holtz, Goodman & Woodward

[57] ABSTRACT

A mold for horizontally and continuously casting molten metal into a cast metal strand, which is horizontally connected, through a front nozzle, a feed nozzle and a break ring to an opening in a lower portion of a side wall of a tundish for a horizontal type continuous casting machine. Molten metal received in the tundish is intermittently and continuously withdrawn into a cast metal strand in the horizontal direction through the mold in a plurality of cycles each comprising one pull and one push. The transverse sectional area of the inner bore of the mold at the inlet end portion thereof becomes gradually larger from the inlet end of the mold toward the middle portion thereof over a prescribed distance (l), and the inner bore of the mold has substantially the same transverse sectional area for the remaining portion other than the inlet portion of the mold over the above-mentioned prescribed distance (l).

7 Claims, 9 Drawing Figures

MOLD FOR HORIZONTALLY AND CONTINUOUSLY CASTING MOLTEN METAL INTO CAST METAL STRAND

FIELD OF THE INVENTION

The present invention relates to a mold for horizontally and continuously casting molten metal into a cast metal strand, which, when casting molten metal into the cast metal strand by a horizontal type continuous casting machine, permits prevention of cracks from occurring along cold shuts produced on the surface portion of a solidified shell of the cast metal strand.

BACKGROUND OT THE INVENTION

In a conventional horizontal type continuous casting machine, a mold is horizontally connected to an opening in a lower portion of a side wall of a tundish for the horizontal type continuous casting machine. FIG. 1 is a schematic vertical sectional view illustrating an example of the junction between a tundish for receiving molten steel and a conventional mold in a conventional horizontal type continuous casting machine. As shown in FIG. 1, the mold 1 is horizontally connected, through a front nozzle 2, a feed nozzle 3 and a break ring 4, to the opening in the lower portion of the side wall 5 of the tundish. One end of the front nozzle 2 is inserted into the opening in the lower portion of the side wall 5 of the tundish, and the other end of the front nozzle 2 is in contact with one end of the feed nozzle 3. The other end of the feed nozzle 3 is in contact with one end of the break ring 4, and the other end of the break ring 4 is in contact with an inner bore 6 at an inlet end of the mold 1. Thus, the opening in the side wall 5 of the tundish, the front nozzle 2, the feed nozzle 3, the break ring 4 and the inner bore 6 of the mold 1 form a horizontal passage for molten metal. The mold 1 is covered by a jacket 7, and a space 8 is formed between the mold 1 and the jacket 7. Cooling water is circulated through the space 8 to cool the mold 1.

Molten steel received in the tundish is withdrawn into a cast steel strand through the mold 1. For the purpose of preventing a very thin solidified shell of the cast steel strand formed near the break ring 4 from breaking, and the solidified shell from sticking to the inner surface of the mold 1, the cast steel strand is intermittently and continuously withdrawn from the mold 1 in the horizontal direction by means of a plurality of cycles each comprising one pull and one push.

FIG. 2 is a descriptive view illustrating an example of the above-mentioned cycle comprising one pull and one push for withdrawing the cast steel strand in the horizontal direction from the mold. In FIG. 2, the abscissa represents time, and the ordinate indicates a pulling speed of the cast steel strand in the portion above point 0 and a pushing speed of the cast steel strand in the portion below point 0. In FIG. 2, the portion "a" represents a pull period in one cycle comprising one pull and one push, the portion "b" represents the last stage of the pull period in the above-mentioned cycle, and the portion "c" represents a push period in the above-mentioned cycle. The distance of one pull in one cycle for withdrawing the cast steel strand is longer than the distance of one push. In the push period "c", the cast steel strand is slightly pushed back in the direction opposite to the withdrawal direction of the cast steel strand in order to prevent cracks from occurring on the surface portion of the solidified shell of the cast steel strand along with shrinkage of the solidified shell of the cast steel strand.

FIGS. 3(A) to 3(C) are partial sectional views illustrating the formation of a solidified shell 10 of the cast steel strand 9 in the inner bore 6 of a conventional mold 1 when intermittently and continuously withdrawing the cast steel strand 9 in the horizontal direction from the mold 1 by means of the above-mentioned method. FIG. 3(A) illustrates the formation of the solidified shell 10 of the cast steel strand 9 during a pull period in one cycle comprising one pull and one push, FIG. 3(B) illustrates the formation of the solidified shell 10 of the cast steel strand 9 during the last stage of the pull period in this cycle, and FIG. 3(C) illustrates the formation of the solidified shell 10 of the cast steel strand 9 during a push period in this cycle. Intermittent withdrawal of the cast steel strand 9 has the effect of causing a thin solidified shell 10 formed near the break ring 4 during the pull period in one cycle to grow thicker during the push period in this cycle as shown in FIG. 3(C), so as to prevent the solidified shell 10 from breaking during the next pull period in the next one cycle.

However, since the cast steel strand 9 is intermittently and continuously withdrawn from the mold 1 by means of a plurality of cycles each comprising one pull and one push, a junction face is produced in the solidified shell 10 of the cast steel strand 9 between a unit shell 10' formed during one cycle comprising one pull and one push and another unit shell 10'' formed during the next one cycle comprising also one pull and one push, as shown in FIGS. 3(A) to 3(C). This junction face is known as a cold shut 11. The above-mentioned cold shut 11 poses no problem so far as it is completely welded, but if it is incompletely welded, a crack may occur, in the mold 1, on the surface portion of the solidified shell 10 of the cast steel strand 9 along the cold shut 11 during the pull period in one cycle for withdrawing the cast steel strand 9, and remains as a flaw on the surface of the cast steel strand 9. This flaw usually has a depth of from 0.5 to 1.5 mm.

Now, the reason for the formation of an incompletely welded cold shut 11 will be described below.

As shown in FIG. 1 and FIGS. 3(A) to 3(C), the inner bore 6 of the conventional mold 1 has a uniform transverse sectional area over the entire length of the mold 1 from the inlet end to the exit end thereof, and the wall of the mold 1 has a uniform thickness. As previously mentioned, the mold 1 is cooled by cooling water circulating through the space 8 formed between the mold 1 and the jacket 7, and the break ring 4 which is in contact with the inner bore 6 of the mold 1, is also cooled by the thus cooled mold 1. Therefore, the corner portion **10*a* of the unit shell 10' (herein referred to as the "corner portion of the unit shell"), which is in contact with the corner formed by the mold 1 and the break ring 4 (hereinafter referred to as the "corner of the inner bore 6"),is cooled more remarkably than the other portion of the unit shell 10', which is in contact only with the mold 1, by means of both the mold 1 and the break ring 4 during the push period in one cycle for withdrawing the cast steel strand 9, and, as a result, the temperature of the corner portion 10*a* of the unit shell 10'** is largely reduced.

FIG. 4 is a graph illustrating the decrease in temperature of the corner portion **10*a* of the unit shell 10', which is in contact with the corner of the inner bore 6 of the conventional mold 1. As shown in FIG. 4, the temperature of the corner portion 10***a* of the unit shell 10' is largely reduced during a very short period of time of only from 0.1 to 0.3 second for which the corner portion 10*a* of the unit shell 10' stays in the corner of the inner bore 6. When the temperature of the corner portion 10*a* of the unit shell 10', which is formed during one cycle for withdrawing the cast steel strand 9, is low, the unit shell 10'', which is newly formed during the next one cycle, is not completely welded together with the corner portion 10*a* of the preceding unit shell 10' . According to experience, when the temperature of the corner portion 10*a* of the unit shell 10' becomes up to 1,400° C., the corner portion 10*a* of the preceding unit shell 10' can no longer be completely welded together with the newly formed unit shell 10''. As a result, an incompletely welded cold shut 11 is produced between the unit shell 10' having a low-temperature corner portion 10*a*, which is formed during one cycle comprising one pull and one push for withdrawing the cast steel strand 9, on the one hand, and the unit shell 10'', which is formed during the next one cycle, on the other hand.

In general, when the number of cycles each comprising one pull and one push for withdrawing the cast steel strand 9 from the mold 1 is larger than 150 cycles/minute, the cold shuts 11 are completely welded, and no cracks occur on the surface portion of the cast steel strand 9 along the cold shuts 11. However, increasing the number of cycles to over 150 cycles/minute causes a heavier load acting on the withdrawal facilities of the cast steel strand 9 including pinch rolls. The number of cycles is thus practically limited to the range of from 50 to 150 cycles/minute. When the number of cycles is within the range of from 50 to 150 cycles/minute, incompletely welded cold shuts 11 are produced for the reason as mentioned above, and cracks occur on the surface portion of the cast steel strand 9 along the incompletely welded cold shuts 11.

Incompletely welded cold shuts are also produced when casting a molten metal other than molten steel into a cast metal strand by the horizontal type continuous casting machine.

Under such circumstances there is a strong demand for development of a mold for horizontally and continuously casting molten metal into a cast metal strand, which, when casting molten metal into the cast metal strand by a horizontal type continuous casting machine, permits prevention of cracks from occurring along cold shuts produced on the surface portion of a solidified shell of the cast metal strand, but a mold for horizontally and continuously casting molten metal into a cast metal strand provided with such characteristics has not as yet been proposed.

SUMMARY OF THE INVENTION

An object of the present invention is therefore to provide a mold for horizontally and continuously casting molten metal into a cast metal strand, which, when casting molten metal into the cast metal strand by a horizontal type continuous casting machine, permits prevention of cracks from occurring along cold shuts produced on the surface portion of a solidified shell of the cast metal strand.

A principal object of the present invention is to provide a mold for horizontally and continuously casting molten metal into a cast metal strand, which, when casting molten metal into a cast metal strand by a horizontal type continuous casting machine, permits prevention of cracks from occurring along cold shuts produced on the surface portion of a solidified shell of the cast metal strand by causing the cold shuts to be completely welded.

In accordance with one of the features of the present invention, there is provided a mold for horizontally and continuously casting molten metal into a cast metal strand using a push-pull molding technique, which comprises:

said mold being horizontally connected, through a front nozzle (2), a feed nozzle (3) and a break ring (4), to an opening in a lower portion of a side wall (5) of a tundish for a horizontal type continuous casting machine, one end of said front nozzle (2) being inserted into said opening in the lower portion of said side wall (5) of said tundish, the other end of said front nozzle (2) being in contact with one end of said feed nozzle (3), the other end of said feed nozzle (3) being in contact with one end of said break ring (4), the other end of said break ring (4) being in contact with an inner bore of said mold at an inlet end thereof, thereby said opening in the lower portion of said side wall (5) of said tundish, said front nozzle (2), said feed nozzle (3), said break ring (4) and said inner bore of said mold forming a horizontal passage for molten metal, molten metal received in said tundish being intermittently and continuously withdrawn into a cast metal strand in the horizontal direction through said mold by means of a plurality of cycles each comprising one pull and one push, and a distance (L) of said one pull being longer than a distance of said one push;

the transverse sectional area of said inner bore (13) for said inlet end portion of said mold (12, 17 or 18) becomes gradually larger from said inlet end of said mold toward the middle portion thereof over a prescribed distance (l), and said inner bore (13) has substantially the same transverse sectional area for the remaining portion of said mold other than said inlet end portion over said prescribed distance (l).

said prescribed distance (l) at said inlet end portion of said mold (12, 17 or 18) is equal to or less than said distance (l) of said one pull in each cycle for said withdrawal of said cast metal strand.

DETAILED DESCRIPTION OF PREFERRED EMBODIMENTS

From the above-mentioned point of view, we carried out extensive studies to develop a mold for horizontally and continuously casting molten metal into a cast metal strand, which, when casting molten metal into a cast metal strand by a horizontal type continuous casting machine, permits prevention of cracks from occurring along cold shuts on the surface portion of a solidified shell of the cast metal strand by causing the cold shuts to be completely welded.

As a result, we obtained the following finding: the cold shuts produced on the surface portion of the solidified shell of the cast metal strand can be completely welded and thus cracks can be prevented from occurring along the cold shuts, by gradually enlarging the transverse sectional area of the inner bore for the inlet end portion of the mold, from the inlet end thereof in contact with the break ring toward the middle portion of the mold, over a prescribed distance l, and keeping substantially the same transverse sectional area of the inner bore for the remaining portion of the mold other than the inlet end portion thereof over said prescribed distance l.

The present invention was made on the basis of the above-mentioned finding. Now, the mold of the present invention for horizontally and continuously casting molten metal into a cast metal strand is described with reference to the drawings.

Figure 5:
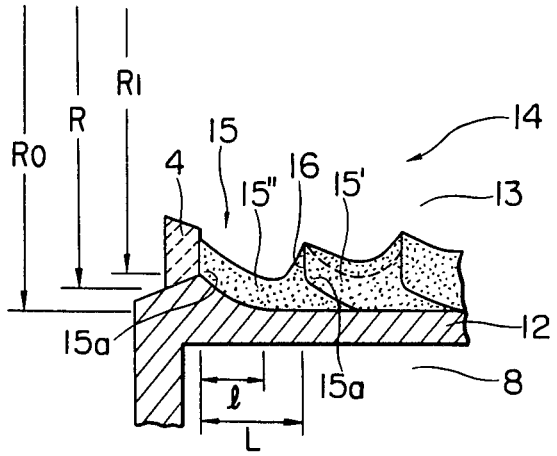
FIG. 5 is a partial vertical sectional view illustrating a first embodiment of the mold of the present invention for horizontally and continuously casting molten metal into a cast metal strand.

FIG. 5 is a partial sectional view illustrating a first embodiment of the mold of the present invention for horizontallly and continuously casting molten metal into a cast metal strand. The most important feature of the mold of the present invention lies in that the caliber of the inner bore for the inlet end portion of the mold is smaller than the caliber of the inner bore for the other portion of the mold. More specifically, as shown in FIG. 5, the transverse sectional area of the circular inner bore 13 for the inlet end portion of the mold 12 becomes gradually larger from the inlet end of the mold 12 toward the middle portion thereof over a prescribed distance l, and the inner bore 13 has substantially the same transverse sectional area for the remaining portion of the mold 12 other than the inlet portion over the above-mentioned prescribed distance l, and the diameter $R_O$ of the inner bore 13 for the remaining portion of the mold 12 is substantially the same as the diameter of a cast metal strand which is cast by the mold 12. In other words, the diameter R of the inner bore for the inlet end portion of the mold 12 becomes gradually larger from the minimum diameter $R_I$ of the inner bore 13 at the inlet end of the mold 12 toward the middle portion thereof over the above-mentioned prescribed distance l, and the diameter R finally reaches the above-mentioned diameter $R_O$ of the inner bore 13 for the above-mentioned remaining portion of the mold 12.

Figure 1:
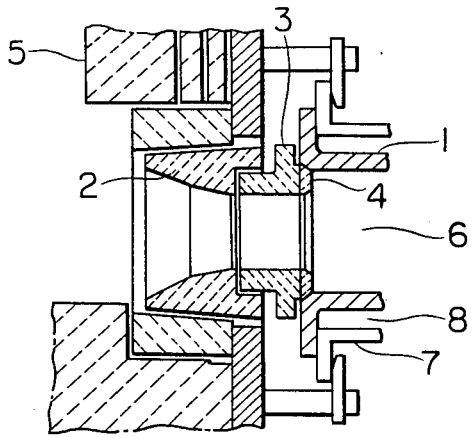
FIG. 1 is a schematic vertical sectional view illustrating an example of the junction between a tundish for receiving molten steel and a conventional mold in a conventional horizontal type continuous casting machine.
Figure 2:
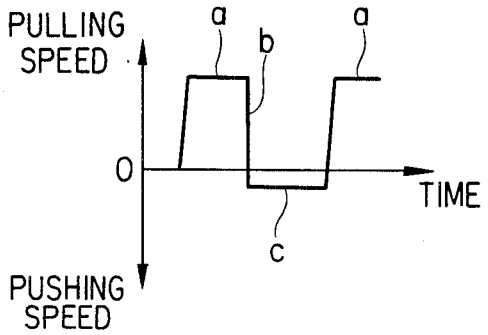
FIG. 2 is a descriptive view illustrating an example of one cycle comprising one pull and one push for intermittently and continuously withdrawing a cast steel strand in the horizontal direction from a mold.
Figure 3A:
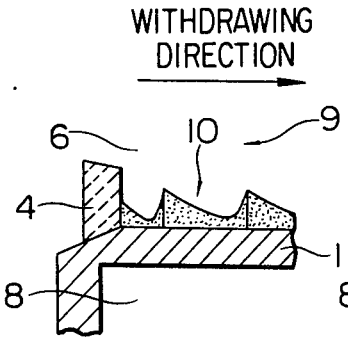
FIG. 3(A) is a partial sectional view illustrating the formation of a solidified shell of a cast steel strand during a pull period in one cycle comprising one pull and one push for intermittently and continuously withdrawing the cast steel strand in the horizontal direction from a conventional mold.
Figure 3B:
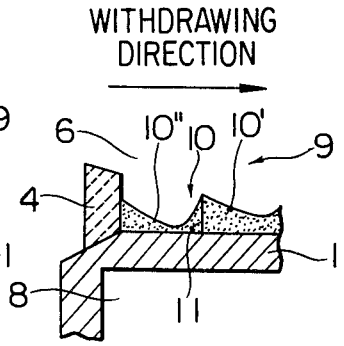
FIG. 3(B) is a partial sectional view illustrating the formation of a solidified shell of a cast steel strand during the last stage of the pull period in one cycle comprising one pull and one push for intermittently and continuously withdrawing the cast steel strand in the horizontal direction from a conventional mold.
Figure 3C:
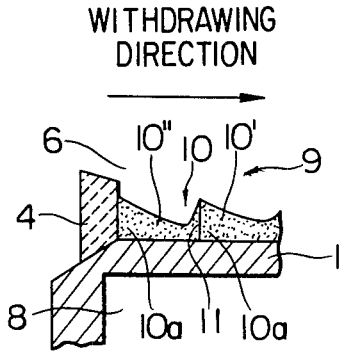
FIG. 3(C) is a partial sectional view illustrating the formation of a solidified shell of a cast steel strand during a push period in one cycle comprising one pull and one push for intermittently and continuously withdrawing the cast steel strand in the horizontal direction from a conventional mold.
Figure 4:
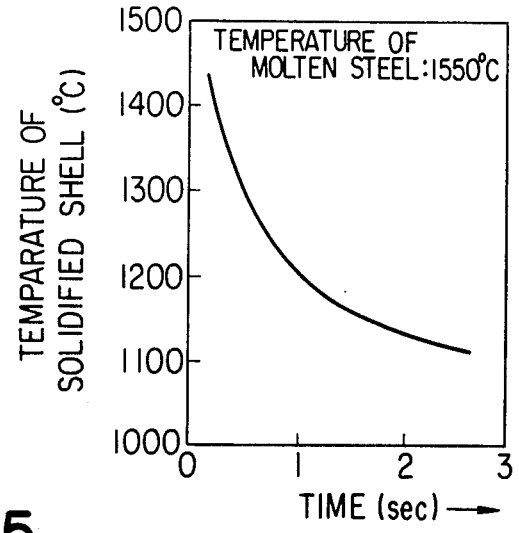
FIG. 4 is a graph illustrating the decrease in temperature of a corner portion of a unit shell of a solidified shell of a cast steel strand, which is in contact with the corner of the inner bore of a conventional mold.

The mold 12 having the inner bore 13 is horizontally connected, similarly to the conventional mold 1 shown in FIG. 1, to an opening in a lower portion of a side wall of a tundish (not shown) for receiving molten metal through a front nozzle (not shown), a feed nozzle (not shown) and a break ring 4. The opening in the side wall of the tundish, the front nozzle, the feed nozzle, the break ring 4 and the inner bore 13 of the mold 12 form a horizontal passage for molten steel. The mold 12 is covered by a jacket (not shown), and a space 8 is formed between the mold 12 and the jacket. Cooling water is circulated through the space 8 to cool the mold 12. The break ring 4 which is in contact with the inner bore 13 of the mold 12, is also cooled by the thus cooled mold 12. Molten steel received in the tundish is intermittently and continuously withdrawn horizontally through the mold 12 into a cast steel strand 14 by means of a plurality of cycles each comprising one pull and one push. The distance L of one pull in one cycle for withdrawing the cast steel strand 14 is longer than the distance of one push.

As shown in FIG. 5, the thickness of the wall of the mold 12 near the corner formed by the mold 12 and the break ring 4 (hereinafter referred to as the "corner of the inner bore 13")is larger than the thickness of the other portion of the wall of the mold 12. Therefore, the corner of the inner bore 13 is cooled less than the corner of the inner bore 6 of the conventional mold 1 having the wall of the uniform thickness as described above with reference to FIG. 1 and FIGS. 3(A) to 3(C). As a result, the corner portion 15*a* of a unit shell 15' of a solidified shell 15 of the cast steel strand 14, which is formed during one cycle comprising one pull and one push for withdrawing the cast steel strand 14 and which is in contact with the corner of the inner bore 13 during the push period in said one cycle, is cooled less than the corner portion 10*a* of the unit shell 10' of the solidified shell 10, which is in contact with the corner of the inner bore 6 of the conventional mold 1.

Furthermore, when the corner portion 15*a* of the unit shell 15' breaks from the corner of the inner bore 13 during the pull period in the next one cycle, the corner portion 15*a* of the unit shell 15' is in contact neither with the cooled mold 12 nor with the cooled break ring 4, and is surrounded by the high-temperature molten steel flowing into the mold 12 from the tundish. Therefore, the corner portion 15*a* of the unit shell 15' rapidly recovers heat from the high-temperature molten steel, and is completely welded together with a unit shell 15'' which is newly formed during the next one cycle. Thus, there is produced a completely welded cold shut 16 between the unit shell 15' and the unit shell 15'', and no crack occurs on the surface portion of the cast steel strand 14 along the cold shut 16.

In addition to the above, the above-mentioned cold shut 16, being produced in the inclined state, is completely crushed during the rolling of the cast steel strand 14 and disappears.

According to the mold 12 of the present invention, as described above, it is possible to prevent cracks from occurring on the surface portion of the solidified shell 15 of the cast steel strand 14 along the cold shuts 16, and furthermore, the following additional effects are available. More specifically, a recess may be caused by partial errosion on the inner bore 13 near the corner of the inner bore 13 during the withdrawal operation of the cast steel strand 14 from the mold 12. When such a recess is produced, the solidified shell formed in the recess is caught by the recess, which acts as a resistance to the pull force during the pull period in one cycle for withdrawing the cast steel strand 14. In the conventional mold 1 shown in FIG. 1 and FIGS. 3(A) to 3(C), the recess is produced on the corner of the inner bore 6 at right angles relative to the withdrawal direction of the cast steel strand 9. Therefore, since the resistance of the solidified shell formed in the recess to the pulling force is considerably large, breakage of the solidified shell 10 of the cast steel strand 9 may occur during the pull period in one cycle. In the mold 12 of the present invention, in contrast, since the recess is produced on the corner of the inner bore 13 at an obtuse angle relative to the withdrawal direction of the cast steel strand 14. Therefore, since the resistance of the solidified shell formed in the recess to the pulling force is relatively small, the solidified shell 15 of the cast steel strand 14 is never broken during the pull period in one cycle.

As previously described, the diameter R of the inner bore 13 for the inlet end portion of the mold 12 in the first embodiment of the present invention shown in FIG. 5, becomes gradually larger from the minimum diameter $R_I$ of the inner bore 13 at the inlet end of the mold 12 toward the maximum diameter $R_O$ corresponding to the diameter of the cast steel strand 14 along a smooth concave over the above-mentioned prescribed distance l. According to experience, the cold shuts 16 are most completely welded when the difference between the maximum diameter $R_O$ of the inner bore 13 and the minimum diameter $R_I$ thereof is within the range of from 4 to 20 mm.

The above-mentioned prescribed distance l from the inlet end of the mold 12 should preferably be up to the distance L of one pull in one cycle for withdrawing the cast steel strand 14. If the prescribed distance l is longer than the distance L of one pull in one cycle, the diameter of the tip of the solidified shell 15 of the cast steel strand 14, which sticks to the end face of a dummy bar inserted into the inner bore 13 of the mold 12 at the beginning of casting of the cast steel strand 14 becomes smaller than the diameter of the cast steel strand 14. As a result, when the solidified shell 15 of the cast steel strand 14, which sticks to the end face of the dummy bar, is withdrawn by the dummy bar by the distance L of one pull, a gap is produced between the solidified shell sticking to the dummy bar and the inner bar 13, and molten steel may leak through this gap toward the outlet end of the mold 12. Since the distance L of one pull is practically within the range of from 5 to 30 mm, the above-mentioned prescribed distance l should preferably be up to the range of from 5 to 30 mm.

Figure 6A:
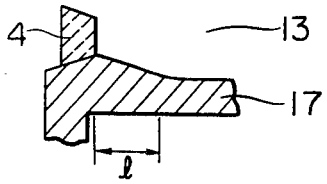
FIG. 6(A) is a partial vertical sectional view illustrating a second embodiment of the mold of the present invention for horizontally and continuously casting molten metal into a cast metal strand.

FIG. 6(A) is a partial vertical sectional view illustrating a second embodiment of the mold of the present invention for horizontally and continuously casting molten metal into a cast metal strand. As shown in FIG. 6(A), the diameter of the inner bore 13 for the inlet end portion of the mold 17 in the second embodiment of the present invention becomes linearly and gradually larger from the minimum diameter of the inner bore 13 at the inlet end of the mold 17 toward the maximum diameter corresponding to the diameter of the cast steel strand over the above-mentioned prescribed distance l. The structure of the other portion of the mold 17 in the second embodiment shown in FIG. 6(A) is the same as that of the mold 12 in the first embodiment shown in FIG. 5.

Figure 6B:
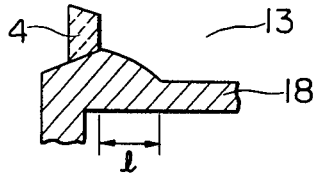
FIG. 6(B) is a partial vertical sectional view illustrating a third embodiment of the mold of the present invention for horizontally and continuously casting molten metal into a cast metal strand.

FIG. 6(B) is a partial vertical sectional view illustrating a third embodiment of the mold of the present invention for horizontally and continuously casting molten metal into a cast metal strand. As shown in FIG. 6(B), the diameter of the inner bore 13 for the inlet end portion of the mold 18 in the third embodiment of the present invention becomes gradually larger from the minimum diameter of the inner bore 13 at the inlet end of the mold 18 toward the maximum diameter corresponding to the diameter of the cast steel strand along a smooth convex over the above-mentioned prescribed distance l. The structure of the other portion of the mold 18 in the third embodiment shown in FIG. 6(B) is the same as that of the mold 12 in the first embodiment shown in FIG. 5.

In the above-mentioned first to third embodiments, the molds of the present invention for horizontally and continuously casting molten steel into a cast steel strand having a circular section have been described. However, the present invention is applicable also to a mold for horizontally and continuously casting molten steel into a cast steel strand having a square section. In the case of a mold for casting a square-section cast steel strand, the mold has an inner bore having a square section, and the dimensions of the square-section inner bore are determined on the basis of a length of a side of the square-section inner bore instead of the diameter of the inner bore 13 of the mold 12 for the cast steel strand 14 having the circular section as shown in FIG. 5.

Needless to say, the molds in the first to third embodiments of the present invention are also applicable to the case of horizontal and continuous casting of molten metal other than molten steel into a cast metal strand.

According to the mold of the present invention, as described above in detail, when intermittently and continuously withdrawing molten metal received in the tundish into a cast metal strand in the horizontal direction through the mold by means of a plurality of cycles each comprising one pull and one push, it is possible to completely weld cold shuts produced on the surface portion of the solidified shell of the cast metal strand and thus prevent cracks from occurring along the cold shuts, thus providing industrially useful effects.

What is claimed is:

1. In a horizontal type continuous casting machine for horizontally and continuously casting molten metal into a cast metal strand, and including a horizontal mold and means for cyclically pulling and pushing the cast metal strand during formation thereof, comprising:

connecting means including at least a front nozzle, a feed nozzle and a break ring, for connecting said horizontal mold to an opening in a lower portion of a side wall of a tundish for a horizontal type continuous casting machine, one end of said front nozzle being inserted into said opening in the lower portion of said side wall of said tundish, the other end of said front nozzle being in contact with one end of said feed nozzle, the other end of said feed nozzle being in contact with one end of said break ring, the other end of said break ring being in contact with an inner bore of said mold at an inlet end thereof, thereby said opening in the lower portion of said side wall of said tundish, said front nozzle, said feed nozzle, said break ring and said inner bore of said mold forming a horizontal passage for molten metal, molten metal received in said tundish being intermittently and continuously withdrawn into a cast metal strand in the horizontal direction through said mold by means of a plurality of cycles each comprising one pull and one push, and a distance (L) of said one pull being longer than a distance of said one push; and the transverse sectional area of said inner bore for said inlet end portion of said mold becomes gradually larger from said inlet end of said mold toward the middle portion thereof over a prescribed distance (l), and said inner bore has substantially the same transverse sectional area for the remaining portion of said mold other than said inlet end portion over said prescribed distance (l);

the improved mold wherein:

said prescribed distance (l) at said inlet end portion of said mold (12, 17 or 18) is equal to or less than said distance (L) of said one pull in each cycle for said withdrawal of said cast metal strand.

2. The apparatus as claimed in claim 1, wherein:

said transverse sectional area of said inner bore (13) of said mold (12, 17 or 18) is circular.

3. The apparatus as claimed in claim 1, wherein:

said transverse sectional area of said inner bore (13) of said mold (12, 17 or 18) is square.

4. The apparatus as claimed in any one of claims 1, 2 or 3, wherein:

said prescribed distance (l) at said inlet end portion of said mold (12, 17 or 18) is within the range of from 5 to 30 mm.

5. The apparatus as claimed in any one of claims 1, 2 or to 3, wherein:

said transverse sectional area of said inner bore (13) for said inlet end portion of said mold (12) becomes gradually larger along a smooth concave over said prescribed distance (l) at said inlet end portion of said mold (12).

6. The apparatus as claimed in any one of claims 1, 2 or to 3, wherein:

said transverse sectional area of said inner bore (13) for said inlet end portion of said mold (17) becomes linearly and gradually larger over said prescribed distance (l) at said inlet end portion of said mold (17).

7. The apparatus as claimed in any one of claims 1, or 2 to 3, wherein:

said transverse sectional area of said inner bore (13) for said inlet end portion of said mold (18) becomes gradually larger along a smooth convex over said prescribed distance (l) at said inlet end portion of said mold (18).

* * * * *